US005284463A

United States Patent [19]

Shields

[11] Patent Number: 5,284,463

[45] Date of Patent: Feb. 8, 1994

[54] WEIGHT LIFTING APPARATUS

[76] Inventor: William D. Shields, 1814 Holly Oaks Lake Rd., E., Jacksonville, Fla. 32225

[21] Appl. No.: 56,562

[22] Filed: Apr. 30, 1993

Related U.S. Application Data

[63] Continuation of Ser. No. 816,576, Jan. 3, 1992, abandoned.

[51] Int. Cl.[5] ..... A63B 21/072

[52] U.S. Cl. ..... 482/107

[58] Field of Search ..... 482/98-104, 482/106-108

[56] References Cited

U.S. PATENT DOCUMENTS

| | | | |
|---|---|---|---|
| 4,076,236 | 2/1978 | Ionel | 482/108 |
| 4,566,690 | 1/1986 | Schook | 482/106 X |
| 4,638,994 | 1/1987 | Gogarty | 482/108 X |
| 4,822,034 | 4/1989 | Shields | 482/106 |
| 4,913,422 | 4/1990 | Elmore et al. | 482/106 |
| 4,955,603 | 9/1990 | Belker | 482/107 |
| 5,024,434 | 6/1991 | Smith | 482/106 X |

FOREIGN PATENT DOCUMENTS

| | | | |
|---|---|---|---|
| 238831 | 8/1925 | United Kingdom | 482/107 |

*Primary Examiner*—Robert Bahr

*Attorney, Agent, or Firm*—Arthur G. Yeager

[57] ABSTRACT

The apparatus is configured as a dumbbell having an elongated hollow lifting bar with a pivotable handle for activating a wedge-shaped cam element mounted to the bar. The cam element longitudinally forces two rods carried in a passageway of the bar to move pin operator elements of each weight. Opposed sides of a weight respectively include a depression or cavity and a laterally extending boss with a boss of one weight fitting within a depression of an adjacent weight. Each boss carries a pair of diametrically opposed inwardly biased pins that are moved outwardly by the element to engage a grooved surface in the depression on an adjacent weight to secure the weights together. Oversized bar alignment rings with essentially identical grooved surfaces are engaged by the pins of a first weight in a series. A support base having a pair of convergent channels to accommodate the alignment rings guides the dumbbell into its resting place. The weights are maintained in movable weight carriers by a spring-loaded weight positioning element to prevent movement of selected adjacent weight carriers when the weights are being secured together.

36 Claims, 3 Drawing Sheets

WEIGHT LIFTING APPARATUS

This is a continuation of copending application(s) Ser. No. 07/816,576 filed on Jan. 3, 1992 now abandoned.

BACKGROUND OF THE INVENTION

Field of the Invention

The present invention pertains to free weight lifting apparatus and securing freeweights to a barbell especially with respect to dumbbells.

Prior Art

Dumbbell weight-lifting apparatus normally consists of a plurality of dumbbells each having a fixed total weight. Other devices employ weights of a generally circular shape with a passageway therethrough and apparatus for securing the weights to a bar. The first group of these devices are often very expensive because a user needs a large number of individual dumbbell weights usually fixed at 5 lb. increments. The latter group requires time and effort to rearrange the weight loading. Modern thinking regarding weight-lifting routines place much emphasis on the timing of exercises and the length of rest between exercise sets. Conventional weight and collar dumbbell systems are too cumbersome to be used as effectively as they could be if they were designed like the present invention.

Finally, dumbbells are often used in exercises where the particular dumbbell can be placed in almost any orientation. Accordingly, freeweight based dumbbell systems must employ weight-securing mechanisms that are safe for use with the dumbbell at any angle they may be held at by a given user.

Devices in the prior art such as U.S. Pat. No. 4,529,198 require a box structure in which to secure a plurality of weights to a bar. Such an approach is unsatisfactory for several reasons. First the large number of spacers 20 and 21 is expensive to manufacture. Secondly, the physical distance across the box 11 is large and thus limits the use of this device in many instances because dumbbells are frequently used in exercise routines where they must be brought close together in a particular way. Accordingly, any dumbbell design that results in large physical dimensions is simply unsuitable for use in many applications. The present invention specifically employs a structure that provides for a safe weight-securing mechanism and the small compact unit needed for dumbbell exercises in addition to providing a weight selection range adequate for the variety of routines needed by the users.

The present invention overcomes the limitations of freeweight selection and securing apparatus in the prior art and is applicable to any freeweight system and especially dumbbells.

SUMMARY OF THE INVENTION

In one embodiment of the present invention there is provided a weightlifting bar having a longitudinal axis and opposite end portions, a plurality of weights each adapted to be attached to an adjacent weight, each weight including selection means for selectively attaching one weight to an adjacent weight, and locking means for detachably securing a first weight to one end portion of the bar for locking the first weight to an adjacent weight of a selected series of adjacent weights attached to each other by the selection means.

In other aspects of the present invention, each weight includes opposite sides and the selection means includes a recess formed in one side of each weight and a pin movably mounted on another side of each weight. The pin of one weight having a first position wherein a portion of the pin is extended within a portion of the recess of another adjacent weight for attaching one weight to another weight and a second position wherein a portion of a pin is removed from the recess for detaching one weight from the other weight. The other side of each weight has a laterally extending boss, the boss of one weight being sized to fit within another portion of the recess on the other weight. The pin is mounted on the boss to position the pin such that it is movable into the portion of the recess into the first position when the boss has been positioned within the other portion of the recess. The weight also includes spaced shoulders within the recess which form a groove and the portion of the pin is in contact with the shoulders of the groove when the pin is in the first position to inhibit relative lateral movement of one weight with respect to the other weight.

Additional aspects are seen wherein the locking means includes a lever means and a movable stop means positionable by the lever means against the pin to inhibit movement of the pin when the pin has been the first position by the lever means. The stop means includes an element having a surface facing the pin and forming a ramp portion with the pin being in contact with the ram portion and being movable laterally of the longitudinal axis in response to movement of the element along the axis. The lifting bar has a passageway communicating between its center portion thereof and the end portions and the locking means includes a pair of oppositely extending rods movably mounted in the passageway and each rod having an end portion thereof in contact with respective stop means to position the stop means against the respective pin. The locking means also includes cam means adjacent to another end portion of each rod for selectively moving respective rod and stop means against the pin. The cam means includes a cam element in contact with each rod and the lever means selectively moves the cam element and the rods to operate the pins between the first and second positions. The selection means further includes spring means to normally bias the pin retracted from the recess and into the second position upon movement of the stop means by the locking means.

Further aspects of this invention are seen in the support means having a plurality of connected members for positioning the weights adjacent each other in a horizontal row and a plurality of weight holders for holding respective weights in upright positions and means movably mounting the weight holders to the support means. The support means further includes a weight positioning member for inhibiting the movement of selected adjacent weights when the respective stop means of adjacent weights are being moved by locking means. The support means also includes spring means attached to the weight positioning member for biasing the positioning member against the weight holders.

The present invention also provides in other aspects an alignment means for positioning the weights in a horizontal row with the support means including means for guiding the movement of the lifting bar. The alignment means includes a base having at least one channel formed therein and the lifting bar includes a circular alignment member disposable within the channel for guiding the lifting bar to a predetermined position on the base. Each weight is circular and has an outwardly opening channel about the circumference thereof and each weight holder fits within a respective outwardly opening channel. Each of the grooves is defined by a circumferential channel within the recess.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE DRAWINGS

Figure 1:
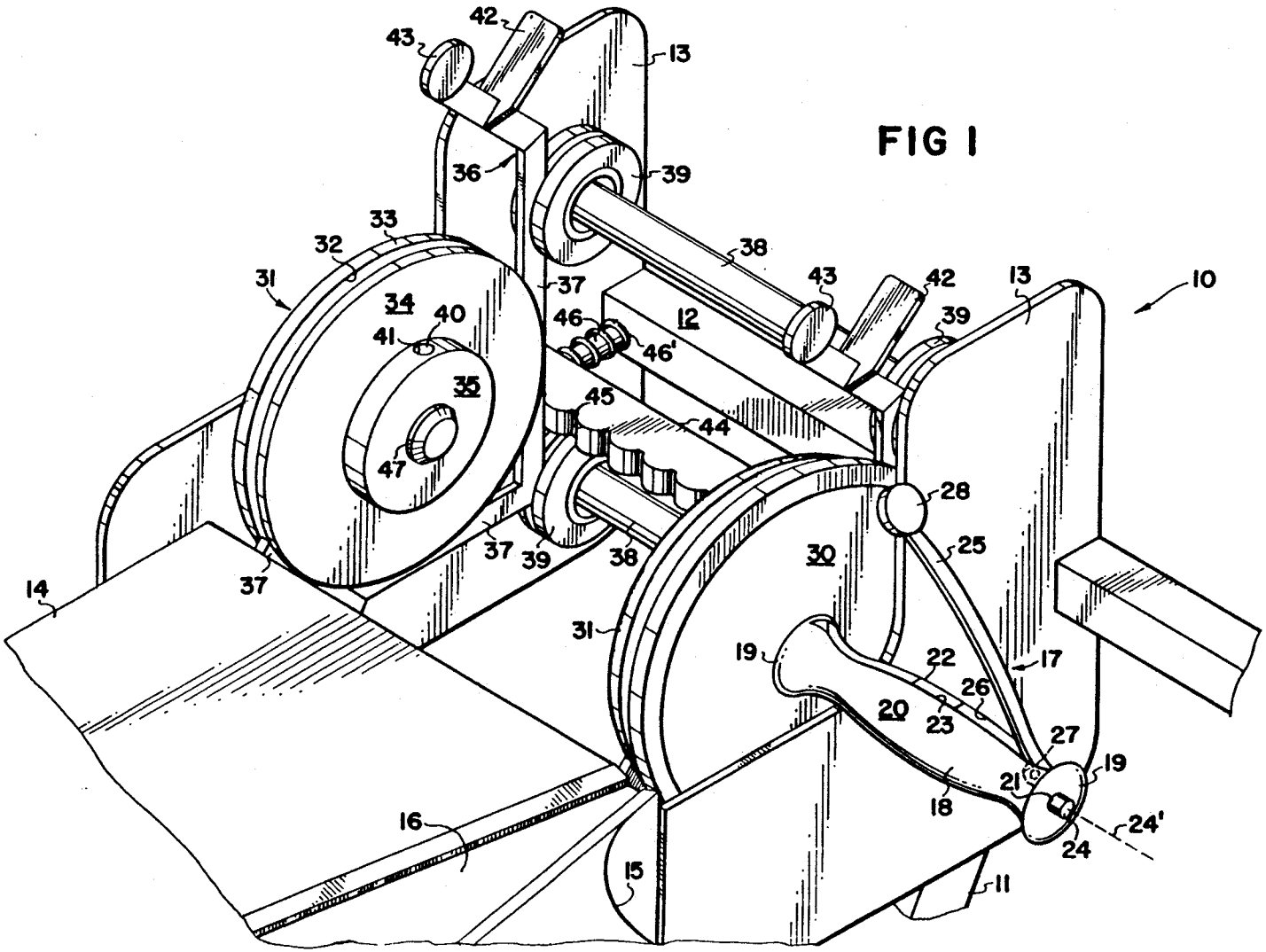
FIG. 1 is a perspective view of the weight-lifting apparatus in accord with the present invention configured as a dumbbell.

Referring now to the drawings, the weight-lifting apparatus is shown in perspective in FIG. 1 configured in the preferred embodiment as a dumbbell system that is depicted generally at numeral 10. A frame 11, illustrated pictorially, is used to support the system 10 at a convenient height and may be of any appropriate structure in the circumstances. An alignment bar 12 is used to connect the end plates 13 to provide overall structural alignment of the system 10. Bar 12 and plates 13 will be attached to the frame 11 by bolts or any other appropriate means. A base plate. 14 includes a handhold space or notch 15 and convergent alignment channels 16 that are used to guide the movement of a single dumbbell 17 when on the base 14. Front wall 14' is used to prevent a dumbbell from inadvertently rolling off the front portion of base 14.

A single dumbbell 17 includes a lifting bar handle 18 with opposite end portions 19 and a central portion 20 and is formed with a passageway 21 communicating between the end portions 19. A wedge cam element 22 is mounted in the central portion 20 in another passageway 23 that communicates through bar 18 into passageway 21. Two cylindrical rods 24, mounted along longitudinal axis 24' of bar 18, only one of which is visible in FIG. 1, are slideably mounted in passageway 21 on either side of the cam element 22.

Cam element 22 is moved downwardly by contact with a handle 25 that is pivotally mounted at pivot 27 to the bar 18 and fits with an elongate channel or slot 26 to place it flush with the surface of handle 18. The handle 25 is operated by pushing down on boss or tab 28. Downward movement of cam element 22 will cause lateral movement of the rods 24 as will be further discussed hereinbelow. The handle 25 may be held in the down position by any number of means such as a detent and spring-loaded ball as is understood in the art.

The opposite end portions 19 of the lifting bar 18 include integral alignment rings 30 which consists essentially of circular metal plates welded to bar 18. The alignment rings 30 ride in channels 16 to guide the movement of a dumbbell 17 and in addition, provide a means whereby a series of weights 31 are attached to the bar 18. Alignment ring 30 is illustrated as being welded to bar 18 in the accompanying drawings. It is important to note, however, that ring 30 could be mounted to bar 18 via roller or ball bearings if so desired in a particular application.

For purposes of illustration only, two weights 31 are shown on the left-hand side of the dumbbell 17. Each weight 31 is a generally circular plate member having opposite sides 33 and 34 and a laterally extending generally circular boss 35 mounted in a weight carrier 36 which is constructed of narrow metal beam members 37 that are mounted to rails 38 on three bushings 39. Rails 38 are mounted to alignment plates 13. Each weight 31 includes a circumferential channel or groove 32 sized to support the weight 31 on a beam 37 in a generally upright position. A tab 42 is used to carry a label indicating the cumulative weight from an alignment ring 30 extending outwardly. A tab or handle 43 is used to push a weight carrier 36 back and forth for loading and unloading the dumbbell 17 as will be described.

Figure 2:
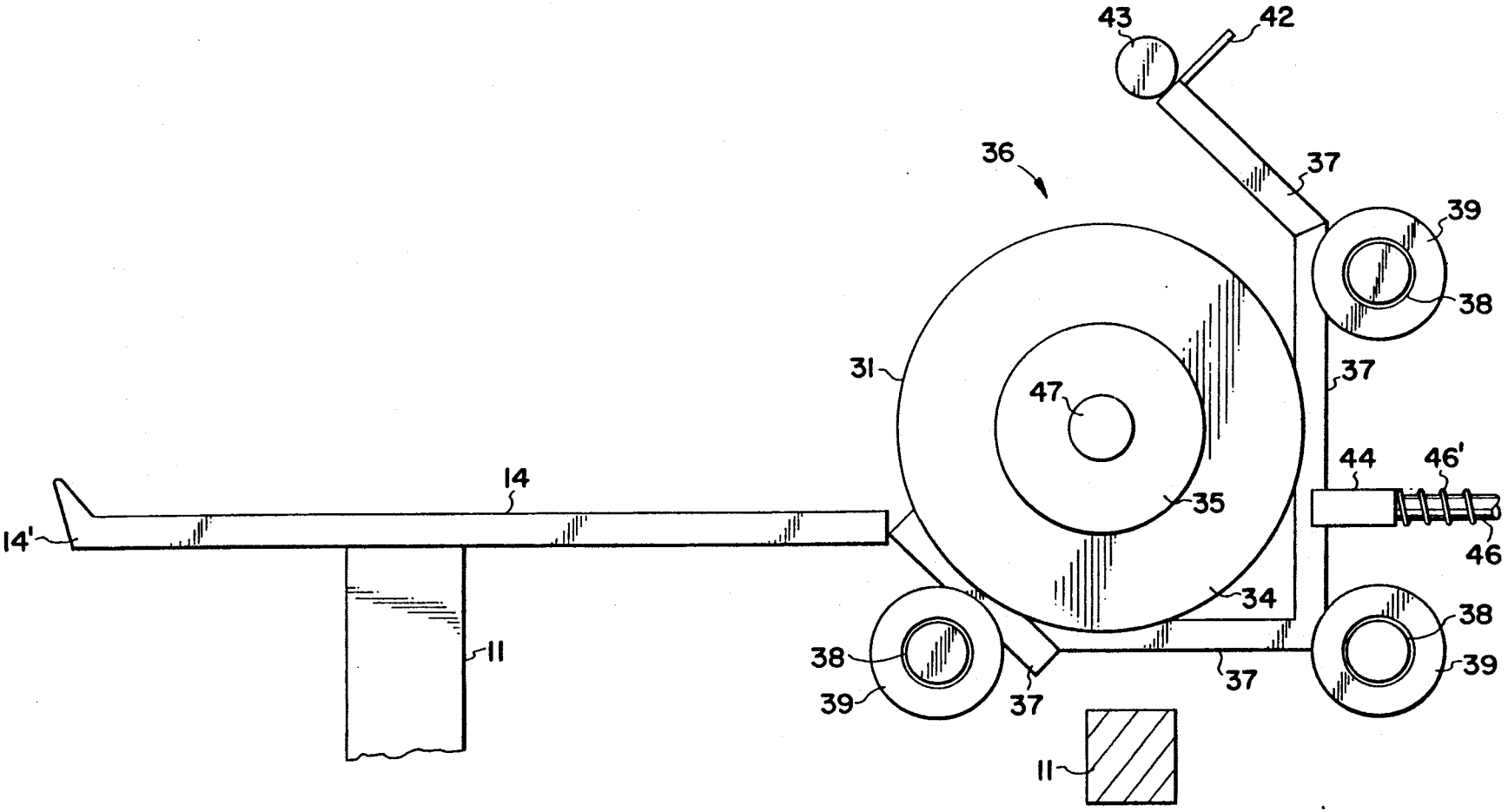
FIG. 2 is a side pictorial view showing the arrangement of a weight carrier used in FIG. 1.

The weight carriers 36 rest against a carrier positioning member 44 which has a plurality of slots 45 into which the vertical beam member 37 fits. The carrier positioning member 44 is mounted to the alignment bar 12 via posts 46 against the loading of the springs 46'. The positioning member 44 holds the carriers 36 and the associated weights 31 in a fixed position as the locking apparatus for securing the weights 31 to the bar 18 is operated as will be discussed. (See also FIG. 2.)

Figure 3:
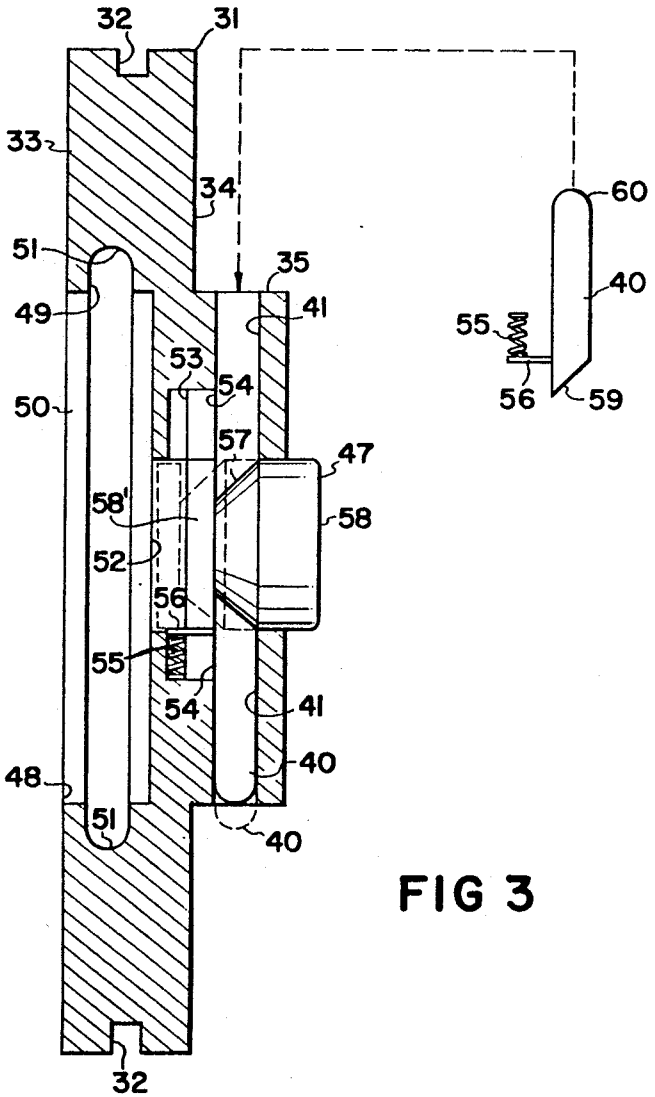
FIG. 3 is a cross-sectional view of a weight used in the present invention.

FIG. 3 details a cross-sectional view of a weight 31 and includes some of the locking and selection apparatus that will be described. Side 33 of the weight 31 has a large circular countersunk cavity or depression 48 that is centrally located and machined from the metal body of the weight 31. The depression 48 is formed to provide a circumferential wall 50 that has a pin recess formed as a channel or groove 49 cut therein to define a ring-like engagement surface 51. The diameter across the depression 48 is sized to accommodate the boss 35 of an adjacent weight 31.

The weight 31 also has two opposed guideways or passageways 41 which communicate between the exterior surface of boss 35 and a second circular passageway or chamber 52 that extends horizontally between the two sides 33 and 34 of the weight 31 with one end of the passageway connecting to depression 48. Extending vertically and adjacent to the passageways 41 are two pairs of slots or channels 53, 54 into each of which fits a spring 55 and a horizontally displaced dowel pin 56 respectively. For purposes of illustration, one pin 40 with accompanying dowel pin 56 and spring 55 is shown installed in a vertical passageway 41 and the other pin/dowel/spring assembly is shown outside of the weight 31.

The dowel pin 56 is rigidly mounted to attachment means formed as a pin 40 and extends laterally where it is attached to a spring 55 by whatever means are appropriate. This arrangement provides that movement of pin 40 is accomplished against spring force when the pin 40 is moved outwardly from the center of the weight 31 to a first position in order to attach one weight 31 to another adjacent weight 31 (or to alignment ring 30) and is spring-loaded to return the pin 40 to a retracted second position (as shown) when a weight 31 is to be detached.

Pin 40 is moved in response to the movement of the pin operator element 47 which has a circular end 58 that is in contact with one end of a moving rod 24 and a notch 57 into which one end portion 59 of the pin 40 fits when it is in the retracted second position. As the pin operator 47 is pushed laterally by a rod 24, the pins 40 are forced to move vertically in their respective passageways 41 with the result that the other upper end 60 of the pin 40 is moved above the surface of the associated boss 35. The slot 54, which accommodates vertical movement of the dowel pin 56, is sized to be smaller than the slot 53 which houses spring 55 in order to prevent outward buckling of the spring 55 under compression.

Figure 4:
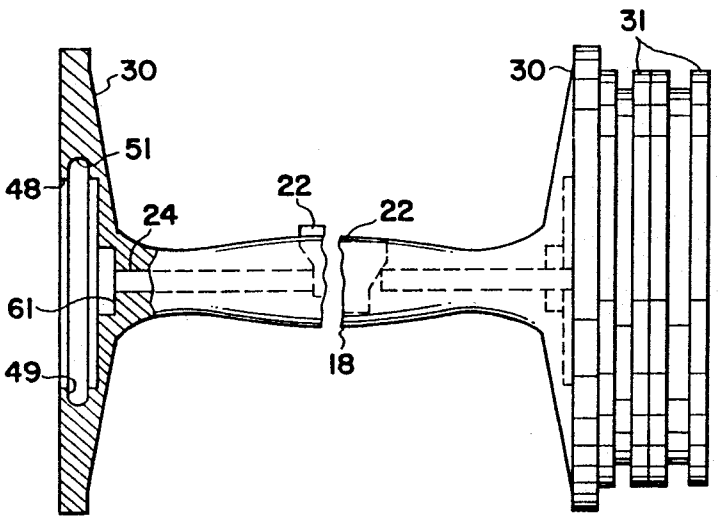
FIG. 4 is a front elevational view of a dumbbell in accord with the present invention with an alignment ring shown in cross-section to illustrate the internal structure thereof.

With reference now to FIG. 4, a front elevational view of the dumbbell handle 18 is illustrated with the left-hand side shown broken away to show the internal structure of an alignment ring 30. The right-hand side of the assembly illustrates a first weight 31 attached to the alignment ring 30 and another weight 31 attached to the first one.

The alignment ring 30 includes a countersunk depression 48 with wall 50 and a groove 49 and surface 51 that are preferably identical with the form of this structure in a weight 31. The ring 30 includes another depression or cavity 61 that is sized to accommodate the pin operator element 47 of a weight 31 when the weight 31 is to be attached to ring 30. The passageway 41 and slots 53 and 54 are not necessary in the ring 30 because it does not employ a spring/pin mechanism. Instead the ring 30 is welded to the handle 18. The rings 30 are thus quite similar to the weights 31 but have a larger diameter, preferably at least ½ inch larger than the weights 31, so that the rings 30 ride in channels 16 and the weights 31 ride on the surface of base 14 during movement of a dumbbell 17. The illustrated alignment ring 30 is representative of the preferred embodiment of the present invention. It is to be understood however, that the physical dimensions of the ring 30 may change in circumstances where the dumbbell assembly 10 is to involve very high weight loading.

With reference now to the appropriate figures, the operation and use of the weight lifting apparatus 10 can now be described.

A locking means includes handle 25 and the ca 22 and rods 24 apparatus along with the alignment ring 30 to secure a first weight 31 to the ring 30 and to secure the rods 24 in their outwardly disposed position. Each weight 31 includes selection means including the spring-loaded pin assembly which itself includes pins 40 with dowels 56 and springs 55 and pin operator element 47 and the associated depression and groove structure.

A first weight 31 is moved to an alignment ring 30 against the spring-loaded weight positioning bar 44 to place boss 35 into depression 48. The weight will be held in position because the weight carrier 36 will be held in a slot 45 in the positioning member 44. This same process can be repeated until the desired number of weights 31 are arranged in a series beginning with the first weight 31 up to the total desired weight loading.

When the dumbbell weights 31 have been selected as desired, the handle 25 is pushed downwardly to push cam element 22 downwardly with the result that the rods 24 will move laterally outward from the center portion 20 of bar 18. The rods 24 are in contact with the respective pin operator elements 47 which are moved laterally causing vertical movement of the associated pins 40 against the bias of springs 55 which are compressed via dowel pin 56. The end portion 60 of pins 40 will be moved into groove 49 and rest against the engagement surface thereof. The lateral movement of the associated weight 31 is thus prevented because lateral movement of a pin 40 is virtually impossible within the limits of the strength of the materials used. The principal support for a particular weight 31, however, is derived from the boss 35 and is strong enough to support the maximum series of weights 31 in a particular design. Handle 25 is held down by the grip of a user in addition to any other means used and accordingly, the weights 31 remain secured to the handle bar 18 until deliberately released by user action.

The dumbbell 17 can then be lifted and the weights 31 are lifted from their respective carriers. After the user completes an exercise routine, the dumbbell 17 can be placed on base 14 and moved to position alignment rings 30 into the channels 16 which, by being convergent, will guide the dumbbell 17 into position adjacent alignment plates 13. The alignment apparatus will ensure that the weights 31 will return to their respective carrier 36. The weights 31 can be detached from each other by lifting handle 25 which will allow rods 24 to be pushed back toward the center portion 20 of bar handle 18. In the preferred embodiment of the invention, the lower end 59 of a pin 40 continues to rest on a portion of the sloped surface of element notch 57 when element 47 is pushed by rod 24 to engage a weight 31 to another weight 31 or alignment ring 30. When the downward pressure is removed from cam element 22 and rod 24 force can push it upward. Spring force from spring 55 via dowel pins 56 will force the pins 40 inward into notch 57 when lateral force of element 47 is removed. Alternatively, as understood in the art, either the rods 24 or cam element 22 or both can be spring-loaded to return to normal upon the lifting of handle 25 to assist releasing the weights 31 from each other.

In the preferred embodiment of the present invention, the weights 31 have a selection means for attaching one weight 31 to another. Generally, this selection means includes the movable pins 40 and the pin operator element 47 and a pin recess that can be engaged by a pin 40. In the preferred embodiment of the invention, the pin recess comprises the groove 49 which is constructed as a ring-like structure for ease of weight attachment. That is to say, rotation of a weight 31 will not affect engagement by a pin 40 from an adjacent weight 31 as would be the case if the pin recess was a simple notch or slot formed in the wall 50 of the depression 48. This latter approach would involve another alignment mechanism to insure proper placement of the weights 31 into a carrier 36 so as to insure proper alignment with an adjacent weight 31. The same design approach is used in the construction of the alignment rings 30. Passageway 52 provides a space for the pin operator element 47 and provides for contact between the elements 47, at the end surfaces 58, 58', of the weights 31 when these weights 31 are arranged in a series beginning with a weight 31 that is attachable to a ring 30. Accordingly, the length of the passageway 52 is sized to accommodate the movement of a given operator element 47 and the distance of travel of the element 47.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a weight lifting apparatus comprising an elongated lifting bar having a longitudinal axis and opposite end portions, a plurality of weights each having opposite sides adjacent each said opposite end portion and each weight being attachable to an adjacent said weight, each said weight including selection means for selectively attaching one said weight to said adjacent weight, and locking means for detachable securing a first said weight to one said end portion of said bar and for locking said first weight to one said end portion of said bar and for locking said first weight to an adjacent said weight of a selected series of said adjacent weights attached to each other by said selection means, said selection means including a movably mounted attachment means being movable laterally of said axis on one said side of each said weight and engagement means on another said side of said weight cooperating with said attachment means of adjacent said weight, said attachment means of one said weight having a first position wherein a portion of said attachment means is to engage said engagement means of an adjacent said weight for attaching said one weight to said adjacent weight and a second position wherein said portion of said attachment means is removed from engagement with said engagement means of an adjacent said weight for detaching said one weight from aid weight, said sides of said weights being formed in a manner to cooperate when one said weight is attached to said adjacent weight to contain said selection means between adjacent said sides of said weight and said adjacent weight to inhibit movement of respective said attachment means and said engagement means except by operation of said locking means.

2. In the apparatus as defined in claim 1 wherein said engagement means includes a recess formed in one said side of each said weight, said portion of said attachment means being positionable to engage said recess in said first portion and being removable from engagement with said recess in said second position.

3. In the apparatus as defined in claim 2 wherein said other side of each said weight has a laterally extending boss, said boss of one said weight being sized to fit within another portion of said recess on said other weight, said attachment means being mounted on said boss to position said attachment means such that it is movable into said portion of said recess into said first position when said boss has been positioned within said other portion of said recess.

4. In the apparatus as defined in claim 2 wherein said weight includes spaced shoulders within said recess forming a groove, said portion of said attachment means being in contact with said shoulders of said groove when said attachment means is in said first position to inhibit relative lateral movement of one said weight with respect to said other weight.

5. In the apparatus as defined in claim 4 wherein each said groove is defined by a circumferential channel within said recess.

6. In the apparatus as defined in claim 1 wherein said locking means includes a operator means and a movable stop means positionable by said operator means against said attachment means to inhibit movement of said attachment means when said attachment means has been moved into said first position by said operator means.

7. In the apparatus as defined in claim 6 wherein said stop means includes an element having a surface facing said attachment means and forming a ramp portion, said attachment means being in contact with said ramp portion and being movable laterally of said longitudinal axis in response to movement of said element along said axis.

8. In the apparatus as defined in claim 7 wherein said lifting bar has a passageway communicating between its center portion thereof and said end portions, said locking means including a pair of oppositely extending rods movably mounted in said passageway and each having an end portion thereof in contact with respective said stop means to position said stop means against respective said attachment means.

9. In the apparatus as defined in claim 8 wherein said selection means further includes spring means to normally bias said attachment means retracted from engagement with said engagement means into said second position.

10. In the apparatus as defined in claim 8 wherein said locking means includes cam means adjacent to another said end portion of each said rod for selectively moving respective said rod and respective said stop means against respective said attachment means.

11. In the apparatus as defined in claim 10 wherein said cam means includes a cam element in contact with each said rod, said lever means selectively moving said element and said rods to operate said pins between said first and second positions.

12. In the apparatus as defined in claim 1 further including support means having a plurality of connected members for positioning said weights adjacent each other in a horizontal row, a plurality of weight holders for holding respective said weight in an upright position and means movably mounting said weight holders to said support means.

13. In the apparatus as defined in claim 12 wherein said support means further includes a weight positioning member for inhibiting the movement of selected adjacent weights when said respective said stop means of adjacent said weights are being moved by said locking means.

14. In the apparatus as defined in claim 13 wherein said support means further includes spring means attached to said weight positioning member for biasing said positioning member against said weight holders.

15. In the apparatus as defined in claim 12 further including alignment means for positioning said weights in a horizontal row, said support means including means for guiding the movement of said lifting bar.

16. In the apparatus as defined in claim 15 wherein said alignment means includes a base having at least one channel formed therein, said lifting bar including an alignment member being disposable within said channel for guiding said lifting bar to a predetermined position on said base.

17. In the apparatus as defined in claim 16 wherein said alignment member is circular.

18. In the apparatus as defined in claim 17 wherein each said weight is generally circular in shape, each said weight having an outwardly opening channel about the circumference thereof, each said weight holder respectively fitting within respective said outwardly opening channel.

19. In a weight lifting apparatus comprising an elongated lifting bar having a longitudinal axis and opposite end portions, a plurality of weights adapted to be attached to at least one said end portion of said bar, support means to position said weights adjacent each other in a horizontal row, locking means for detachably securing a first said weight to said one end portion of said bar, each said weight including selection means for attaching said weight to an adjacent said weight, said selection means including at least one attachment means carried by each said weight having opposite end portions and engagement means on said weight cooperating with said attachment means of an adjacent said weight, said selection means further including a movable operator element mounted to each said weight and in contact with one said end portion of said attachment means for moving said attachment means laterally of said axis to engage said engagement means of an adjacent said weight, said attachment means having a first position wherein another said end portion of said attachment means is moved into engagement with said engagement means of an adjacent said weight for securing respective said weight to an adjacent said weight and a second position wherein said another end portion is removed from engagement for detaching said weight from said adjacent weight, said locking means further including movable means for selectively moving said operator element to correspondingly move respective said attachment means between said first and second positions, said weights having opposite sides, said sides of said weights being formed in a manner to cooperate when one said weight is attached to said adjacent weight to contain said selection means between adjacent said sides of said attached weights to inhibit movement of a respective said attachment means and said operator element except by operation of said locking means.

20. In the apparatus as defined in claim 19 wherein each said weight includes a plate member having a first and second side and a laterally extending boss projecting from said first side, said boss having a generally circular passageway formed therein, and at least one guideway communicating between said passageway and the exterior surface of said boss, said attachment means being adapted to fit within said guideway and movable therein, said attachment means operator element being positioned within said passageway and being movable longitudinally by said movable means to move said attachment means between said first and second position.

21. In the apparatus as defined in claim 20 wherein each said engagement means includes first recess includes a circular countersunk depression formed in a vertical plane in each said second side, said depression having a circumferential wall and a channel formed in said wall for providing a ring-like engagement surface, said depression sized to accept respective said boss of an adjacent said weight therein, said channel being formed in said wall at a position laterally aligned with respect to said guideway when one said boss is positioned within said depression of an adjacent weight.

22. In the apparatus as defined in claim 22 wherein said attachment means is sized to be positioned in contact with said engagement surface of said channel when said attachment means is in said first position thereby to inhibit longitudinal movement of one said weight with respect to said adjacent weight.

23. In the apparatus as defined in claim 22 wherein said selection means includes spring means for biasing said attachment means in contact with said pin operator element.

24. In the apparatus as defined in claim 23 wherein said attachment means operator element includes a notch, said attachment means being spring-loaded to be in contact with said notch when said attachment means is in said second position to inhibit movement of said element when said weight is detached from said adjacent weight.

25. In the apparatus as defined in claim 21 further including positioning means to move one said boss of said weight into said depression of another said weight to position respective said attachment means elements in contact with each other so as to translate movement of one said element to cause movement of said element of an adjacent said weight.

26. In the apparatus as defined in claim 25 wherein said support means further includes stop means for inhibiting the movement of said positioning means during movement of said attachment means elements by said movable means.

27. In the apparatus as defined in claim 26 wherein said selection means includes spring means to normally bias said attachment means retracted from said engagement surface when said attachment means is in said second position.

28. In the apparatus as defined in claim 20 wherein said movable means includes a pair of oppositely extending rods movably mounted in said passageway and having opposite end portions and cam means in contact with one said end portion of each said rod for moving said rod, said other end portion of each said rod being in contact with said attachment means operator element of said first weight for moving said attachment means operator element, said locking means further including lever means for moving said cam means and said rods to cause movement of said attachment means to said first position in respective adjacent said weights associated with respective said other end portions of respective said rods.

29. In the apparatus as defined in claim 19 wherein said lifting bar has a passageway communicating between said end portions, said locking means including a pair of oppositely extending rods movably mounted in said passageway and having opposite end portions and being slideably movable in said passageway, one said end portion of each said rod being in contact with respective said attachment means operator element for moving said element and respective attachment means in contact therewith between said first and second positions.

30. In the apparatus as defined in claim 19 wherein said support means includes a frame including a plurality of members, a plurality of weight holders for holding each respective weight in an generally upright position, means for movably mounting said weight holders to said frame to selectively position said weights carried thereby closely adjacent each other in a horizontal row.

31. In the apparatus as defined in claim 30 wherein said support means further includes a weight positioning member for inhibiting the movement of selected adjacent weights when said attachment means operator elements are being moved by said locking means to position all said attachment means of adjacent said selected said weights in said first position.

32. In the apparatus as defined in claim 31 wherein said support means further includes spring means attached to said positioning member to bias said positioning member against said weight holders.

33. In the apparatus as defined in claim 19 wherein said support means includes alignment means for guiding the movement of said lifting bar.

34. In the apparatus as defined in claim 33 wherein said alignment means includes a base having at least one channel formed therein, said lifting bar including an alignment member, said alignment member being disposable within said channel for guiding said lifting bar to a predetermined position on said base.

35. In a weight lifting apparatus comprising an elongated lifting bar having a longitudinal axis and opposite end portions and having a passageway communicating between its center portion and said end portions, a plurality of weights each having opposite sides adjacent each said opposite end portion and each weight being attachable to an adjacent said weight, each said weight includes selection means for selectively attaching one said weight to said adjacent weight, and locking means for detachably securing a first said weight to one said end portion of said bar and for locking said first weight to an adjacent said weight of a selected series of said adjacent weights attached to each other by said selection means, said selection means including a movably mounted attachment means being movable laterally of said axis on one said side of each said weight and engagement means on another said side of said weight cooperating with said attachment means of an adjacent said weight, said attachment means of one said weight having a first position wherein a portion of said attachment means is to engage said engagement means of an adjacent said weight for attaching said one weight to said adjacent weight and a second position wherein said portion of said engagement means is removed from engagement with said engagement means of an adjacent said weight for detaching said one weight from said weight, said locking means including a pair of oppositely extending rods movably mounted in said passageway and each having an end portion thereof in contact with respective said movably mounted attachment means to move said attachment means between said first and second positions.

36. In a weight lifting apparatus comprising an elongated lifting bar having a longitudinal axis and opposite end portions, a plurality of weights adjacent each said opposite end portions and each weight being attachable to an adjacent said weight, support means having a plurality of connected members for positioning said weights adjacent each other in a horizontal row and a plurality of weight holders for holding respective said weight in an upright position and means movably mounting said weight holders to said support means.

* * * * *